US005512165A

United States Patent [19]

Liu

[11] Patent Number: 5,512,165

[45] Date of Patent: Apr. 30, 1996

[54] PERSONAL TOOL BOX

[76] Inventor: Lai-Ho Liu, No. 8, Taming Lane, Hsinkuang Rd., Taiping Hsiang, Taichung Hsien, Taiwan

[21] Appl. No.: 495,705

[22] Filed: Jun. 27, 1995

[51] Int. Cl.[6] ..... B65D 85/20

[52] U.S. Cl. ..... 206/234; 206/374; 206/378; 206/379; 211/69; 224/904; 312/249.2

[58] Field of Search ..... 206/234, 378, 206/379, 372, 373, 374, 375, 315.11; 312/249.2; 224/249, 241, 251, 252, 904; 211/69, 131, 128

[56] References Cited

U.S. PATENT DOCUMENTS

| | | | |
|---|---|---|---|
| 4,765,470 | 8/1988 | Curci | 206/315.11 |
| 4,930,628 | 6/1990 | Bridges | 206/378 |
| 5,108,287 | 4/1992 | Yee et al. | 206/379 |
| 5,203,469 | 4/1993 | Chang et al. | 206/378 |
| 5,326,068 | 6/1994 | Spears | 211/69 |
| 5,341,975 | 8/1994 | Marinescu | 224/904 |

*Primary Examiner*—Paul T. Sewell
*Assistant Examiner*—Luan K. Bui
*Attorney, Agent, or Firm*—Bacon & Thomas

[57] ABSTRACT

A personal tool box including a base frame having vertically aligned tool rest holes for resting a hand tool, two pivots vertically connected to the base frame in parallel, pairs of bit carriages and pairs of socket carriages and pairs of storage cases respectively turned about the pivots at different elevations for keeping tool bits, sockets, accessories, etc., and a clip at the back side of the base frame for hanging the personal tool box on the user's belt.

2 Claims, 5 Drawing Sheets

PERSONAL TOOL BOX

BACKGROUND OF THE INVENTION

The present invention relates to tool boxes, and relates more particularly to a personal tool box which comprises a base frame, that can be hung on the user's belt to carry, and a variety of carriages and storage cases respectively turned about two pivots on the base frame for keeping tool bits, sockets, accessories, etc.

A variety of handy tool boxes have been disclosed, and have appeared on the market. FIG. 1 shows a regular handy tool box which is comprised of two flat shells hinged together, each shell defining a variety of compartments for keeping tool bits, sockets, accessories, etc. This structure of handy tool box must be carried by hand. When at the job site, the handy tool box must be opened and placed on the ground or a neary place. If the handy tool box is left at a distance from the working area, the user shall have to frequently move between the working area and the handy tool box to change the tool bits or sockets or to select different accessories.

SUMMARY OF THE INVENTION

The present invention has been accomplished to provide a personal tool box which eliminates the aforesaid problem. According to one aspect of the present invention, the personal tool box comprises a base frame having vertically aligned tool rest holes for resting a hand tool, two pivots vertically connected to the base frame in parallel, pairs of bit carriages and pairs of socket carriages and pairs of storage cases respectively turned about the pivots at different elevations for keeping tool bits, sockets, accessories, etc. According to another aspect of the present invention, the base frame has a clip at the back side for hanging the personal tool box on the user's belt.

DETAILED DESCRIPTION OF THE PREFERRED EMBODIMENT

Figure 1:
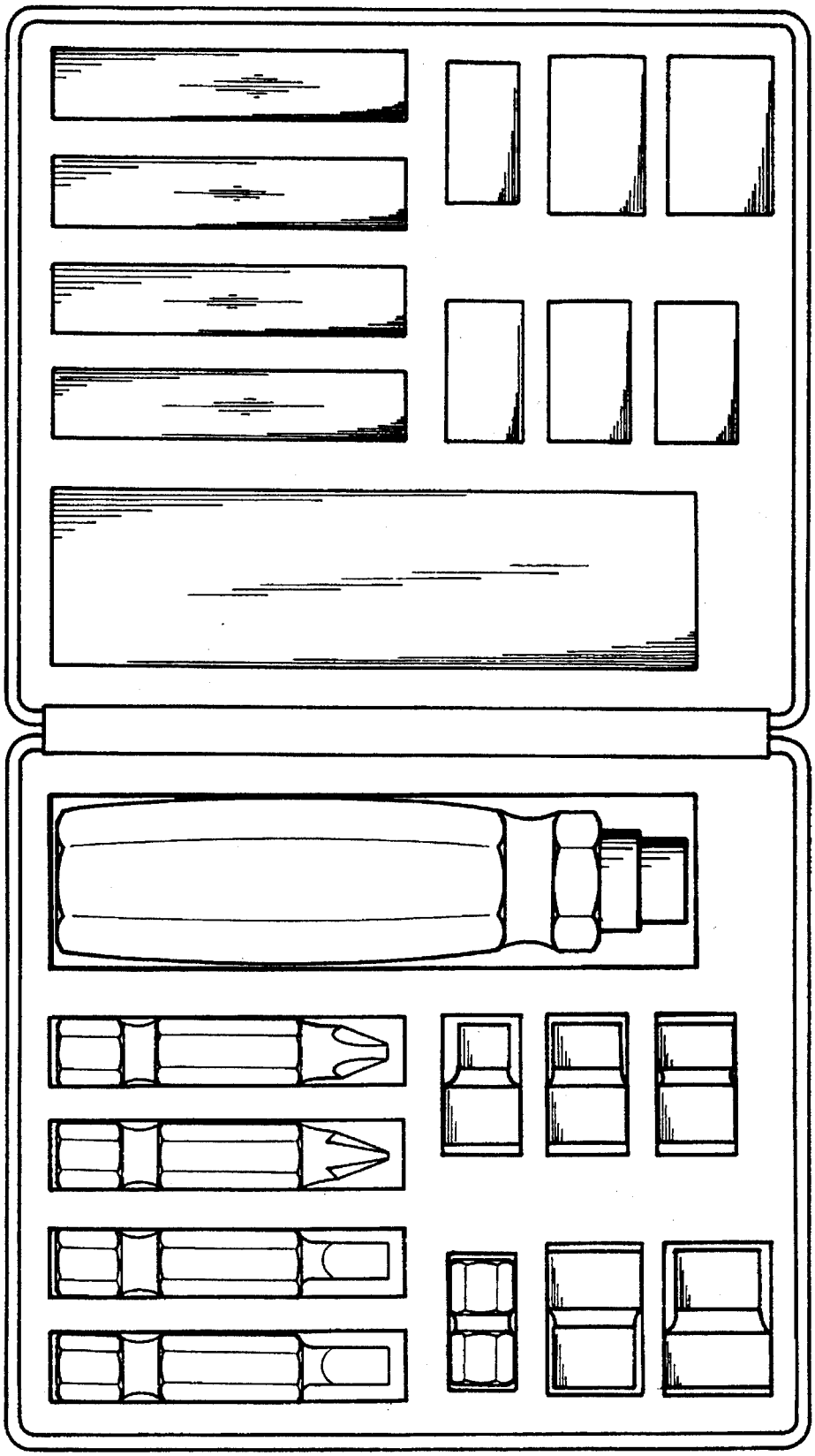
FIG. 1 (PRIOR ART)
FIG. 1 is an extended-out view of a handy tool box according to the prior art.
Figure 2:
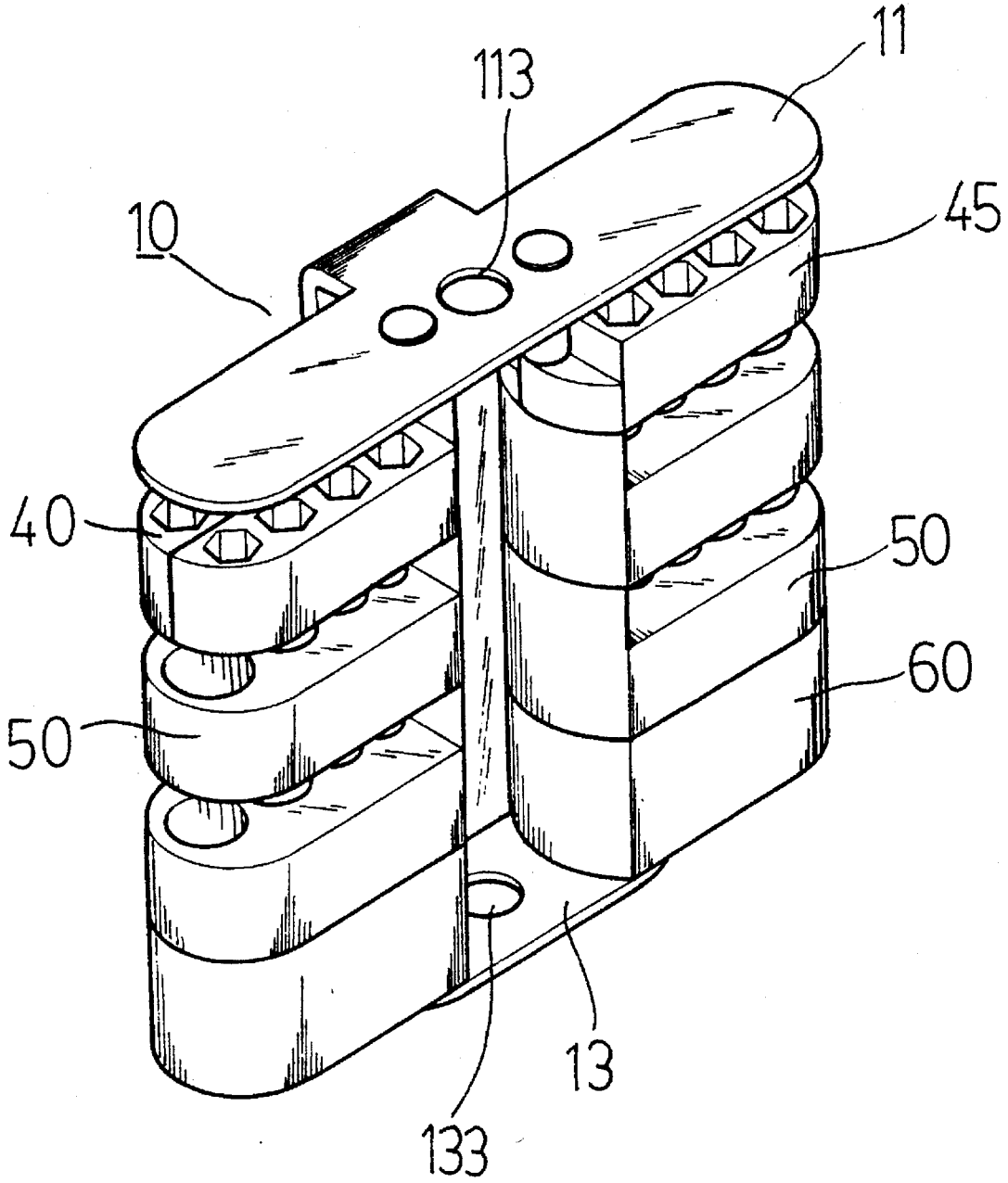
FIG. 2 is an elevational view of a personal tool box according to the present invention.
Figure 3:
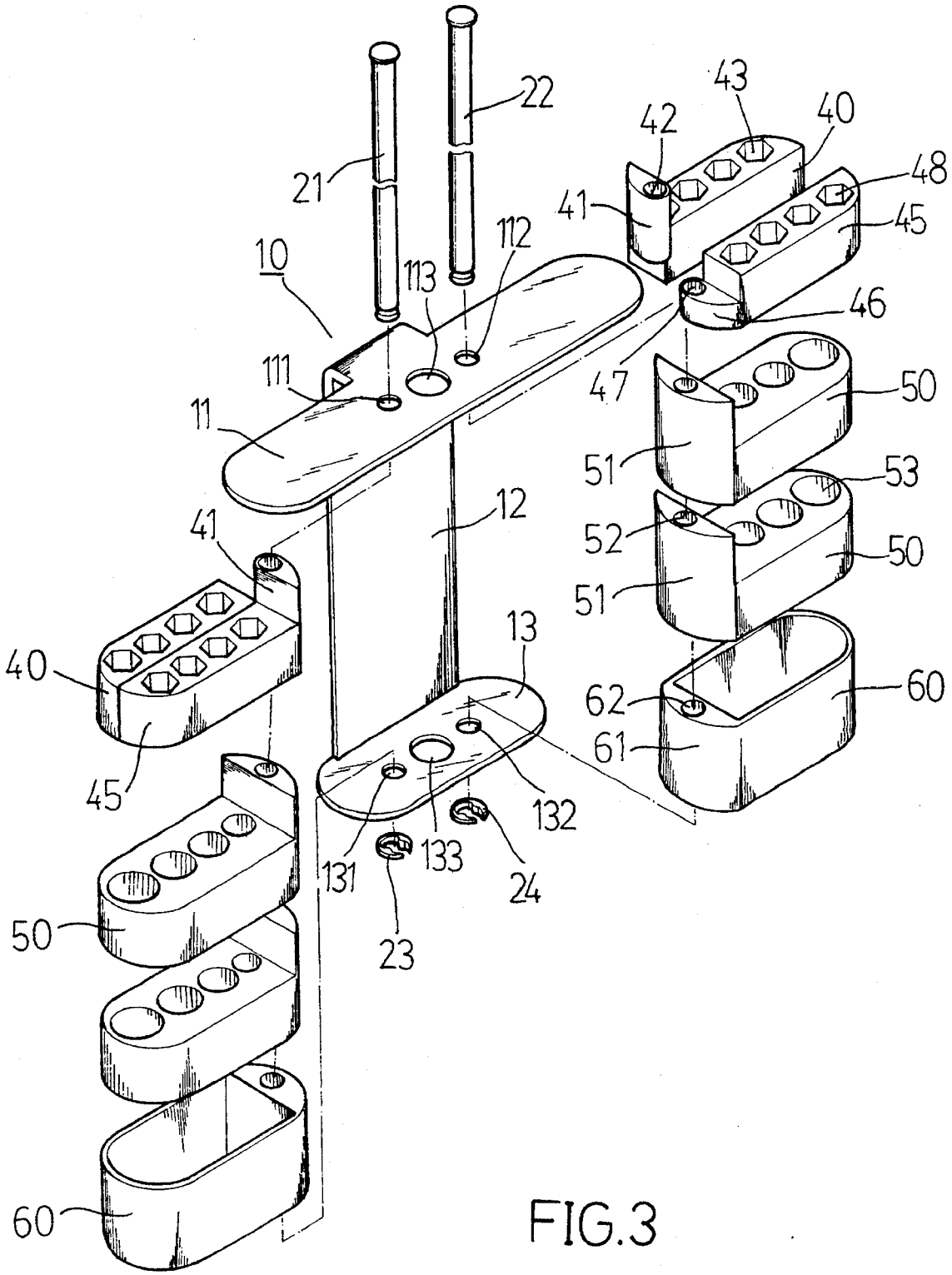
FIG. 3 is an exploded view of the personal tool box shown in FIG. 2.

Referring to FIGS. 2 and 3, a personal tool box in accordance with the present invention is generally comprised of a base frame 10, pairs of bits carriages 40 and 45, a plurality of socket carriages 50, and a plurality of storage cases 60. The base frame 10 comprises a horizontal top wall 11, a horizontal bottom wall 13, and an upright back wall 12 connected between the horizontal top wall 11 and the horizontal bottom wall 13. The horizontal top wall 11 has a tool rest hole 113 at the center and two pivot holes 111 and 112 at two opposite sides relative to the tool rest hole 113. The horizontal bottom wall 13 has a tool rest hole 133 and two pivot holes 131 and 132 corresponding to the tool rest hole 13 and pivot holes 111 and 112 on the horizontal top wall 11. Two headed pivots 21 and 22 are respectively inserted into the pivot holes 111 and 112 on the horizontal top wall 11 and the pivot holes 131 and 132 on the horizontal bottom wall 13 and then secured in place by clamps 23 and 24. The pairs of bit carriages 40 and 45 are respectively turned about the headed pivots 21 and 22, each pair of bit carriages 40 and 45 including a first bit carriage 40 and a second bit carriage 45 connected in parallel. The first bit carriage 40 has a plurality of hexagonal storage chambers 43 at the top side for keeping tool bits, an axle holder 41 at one end turned about one headed pivot 21 or 22, and an axle hole 42 through the axle holder 41 for the insertion of the headed pivot 21 or 22. The second bit carriage 45 has a plurality of hexagonal storage chambers 48 at the top side for keeping tool bits, an axle holder 45 turned about one headed pivot 21 or 22 and attached to the bottom side of the axle holder 41 of the first bit carriage 40 of the same pair, and an axle hole 47 alinged with the axle hole 42 on the corresponding first bit carriage 40 for the insertion of the respective headed pivot 21 or 22. The socket carriages 50 are respectively turned about the headed pivots 21 and 22, each having a plurality of circular chambers 53 of different diameters at the top side for keeping a variety of sockets, an axle holder 51 at one end turned about one headed pivot 21 or 22, and an axle hole 52 through the axle holder 51 for the insertion of the headed pivot 21 or 22. The storage cases 60 are respectively turned about the headed pivots 21 and 22 for keeping accessories, each having an axle holder 61 at one end turned about one headed pivot 21 or 22, and an axle hole 62 through the axle holder 61 for the insertion of the headed pivot 21 or 22.

Figure 4:
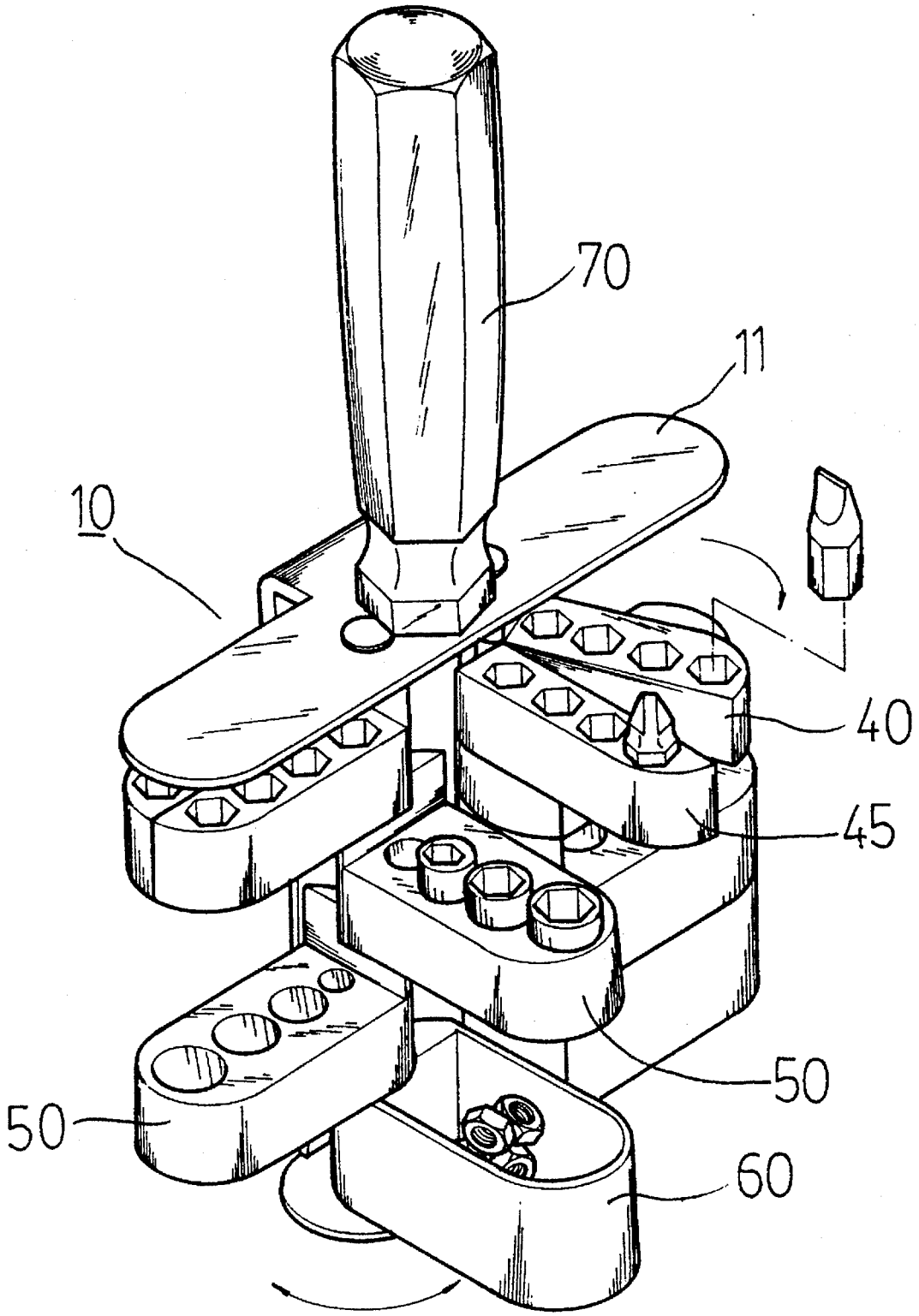
FIG. 4 shows one arrangement of the personal tool box according to the present invention.
Figure 5:
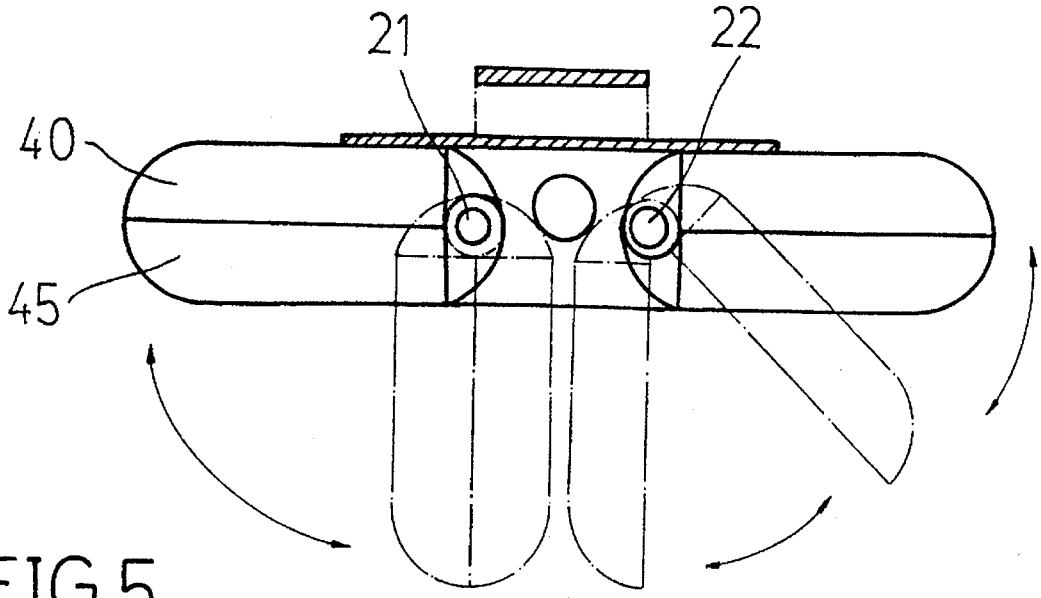
FIG. 5 is a top view in section showing the the personal tool box arranged according to the present invention.

Referring to FIGS. 4 and 5 and FIG. 3 again, a hand tool 70 can be inserted into the tool rest holes 113 and 133 and rested on the base frame 10, the bit carriages 40 and 45 and the socket carriages 50 as well as the storage cases 60 can be respectively turned inwards or outwards about the headed pivots 21 and 22 for keeping tool bits, sockets, and accessories.

Figure 6:
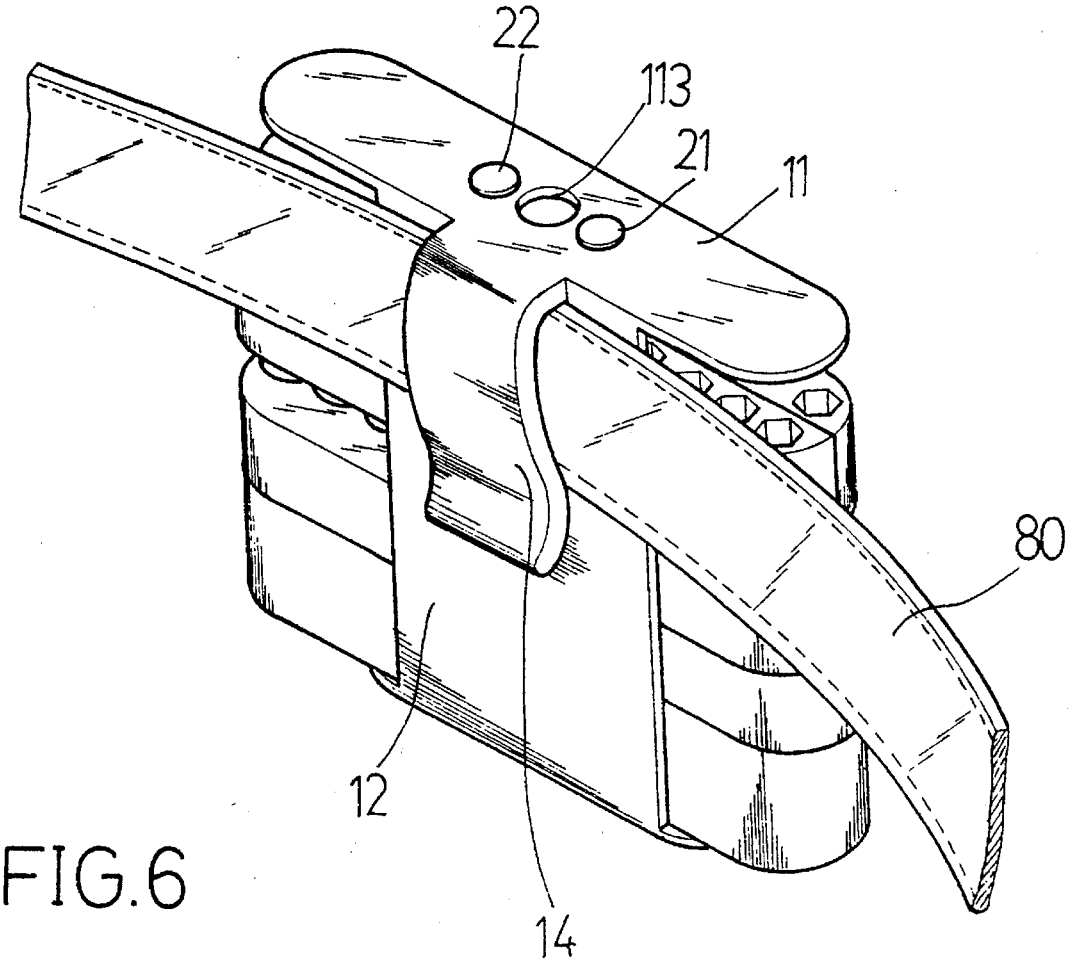
FIG. 6 shows the personal tool box hung on the belt according to the present invention.

Referring to FIG. 6, the base frame 10 further comprises a back clip 14 for hanging on the user's belt 80. Therefore, when the personal tool box is hung on the user's belt, the user can conveniently pick up the hand tool 70, the tool bits, the sockets, as well as the accessories from the personal tool box for use.

While only one embodiment of the present invention has been shown and described, it will be understood that various modifications and changes could be made without departing from the spirit and scope of the invention disclosed.

I claim:

1. A personal tool box comprising:

a base frame having a horizontal top wall, a horizontal bottom wall, and an upright back wall connected between said horizontal top wall and said horizontal bottom wall, said horizontal top wall and said horizontal bottom wall each having a tool rest hole aligned with each other for resting a hand tool;

two pivots connected in parallel between said horizontal top wall and said horizontal bottom wall;

at least one pair of bit carriages respectively turned about said pivots, each pair of bit carriages including a first bit carriage and a second bit carriage abutted against each other at the same elevation and respectively turned about one pivot, each bit carriage having a plurality of hexagonal storage chambers at a top side for keeping tool bits;

at least one pair of socket carriages respectively turned about said pivots below said at least one pair of bit carriages, each socket carriage having a plurality of circular chambers of different diameters at a top side for keeping a variety of sockets; and at least one pair of storage cases respectively turned about said pivots below said at least one pair of socket carriages for keeping accessories.

2. The personal tool box of claim 1 wherein said base frame further comprises a back clip for hanging on the user's belt.

* * * * *